United States Patent [19]

Thurston

[11] Patent Number: 5,036,791

[45] Date of Patent: Aug. 6, 1991

[54] STACKABLE ROAD DELINEATOR

[76] Inventor: Kurt W. Thurston, 475 Hill St., Reno, Nev. 89501

[21] Appl. No.: 614,580

[22] Filed: Nov. 14, 1990

Related U.S. Application Data

[63] Continuation of Ser. No. 183,381, Apr. 13, 1988, abandoned, which is a continuation of Ser. No. 53,105, May 21, 1987, abandoned.

[51] Int. Cl.[5] ..... E01F 13/00

[52] U.S. Cl. ..... 116/63 C; 116/63 P

[58] Field of Search ..... 116/63 P, 63 C, DIG. 16; 404/6, 9–11; 40/612

[56] References Cited

U.S. PATENT DOCUMENTS

| | | | |
|---|---|---|---|
| 2,483,734 | 10/1949 | Neal | 116/63 C |
| 2,762,328 | 9/1956 | Weig | 116/63 C |
| 2,817,308 | 12/1957 | Scanlon | 116/63 C |
| 2,957,444 | 10/1960 | Boettler | 116/63 C |
| 3,099,244 | 7/1963 | Knapp | 116/63 C |
| 3,380,428 | 4/1968 | Abrams | 116/63 P |
| 3,451,368 | 6/1969 | Keats | 116/63 C |
| 3,809,007 | 5/1974 | Brown | 116/63 P |
| 3,952,690 | 4/1976 | Rizzo et al. | 116/63 C |

FOREIGN PATENT DOCUMENTS

| | | | |
|---|---|---|---|
| 216329 | 12/1956 | Australia | 116/63 C |
| 665785 | 1/1952 | United Kingdom | 116/63 C |
| 2077332 | 12/1981 | United Kingdom | 116/63 C |
| 2090313 | 7/1982 | United Kingdom | 116/63 C |
| 2156409 | 10/1985 | United Kingdom | 116/63 C |

*Primary Examiner*—William A. Cuchlinski, Jr.
*Assistant Examiner*—W. Morris Worth
*Attorney, Agent, or Firm*—Flehr, Hohbach, Test, Albritton & Herbert

[57] ABSTRACT

A stackable road delineator includes an upright conical portion with a detachable weighted base. The top conical end has a handle graspable by the fingers of a human hand. Also, this end has a conical hollow interior so that when it is stacked on top of another similar delineator, the handle will freely fit within this hollow interior to thus provide stackable delineators.

8 Claims, 1 Drawing Sheet

STACKABLE ROAD DELINEATOR

This is a continuation of application Ser. No. 183,381 filed Apr. 13, 1988, now abandoned, which is a continuation of application Ser. No. 053,105 filed May 21, 1987, now abandoned.

CROSS REFERENCE TO A RELATED APPLICATION

This application is related to the design patent application entitled, Road Delineator, filed April 20, 1987 (Serial No. not yet assigned), in the name of the same inventor. The ornamental appearance of the embodiment shown in FIG. 1 is claimed in the design patent application.

BACKGROUND OF THE INVENTION

Road delineators are commonly formed of a cylindrical plastic upright portion which may be colored highway orange, for example, and with a weighted detachable plastic base. A delineator is normally distinguished from a traffic road cone because it is substantially higher by perhaps one to two feet. Thus, typical heights of a delineator might be 42" whereas a road cone is 28". Traffic road cones are primarily used as temporary or daytime markers whereas delineators are equipped with reflective bands and are used for day or night traffic control. Delineators in some cases replace barricades.

Some road cones include a weighted plastic base which is normally an integral part of the cone portion. Sometimes to provide extra weight an extra ring may be placed over the cone. Such cones are of course stackable. But with the weighted base, they are difficult to separate. In comparison, the normal highway cone without the weighted base may easily be stacked and then later easily pulled apart. In general, road cones—because of their generally unweighted nature and lower height of, for example, 28" with an 10" base—are used for different purposes than the higher cylindrical delineator. In general, cones have not been made of any greater height because of stability and handling problems.

OBJECT AND SUMMARY OF THE INVENTION

It is therefore a general object of the present invention to provide a stackable road delineator.

In accordance with the above object, there is provided a stackable road delineator having an upright portion and a detachable weighted base portion comprising an upright portion which is conically shaped, having a conical hollow interior, with its larger lower end flanged to retain the weighted base and its smaller upper end terminating in handle means, graspable by the fingers of a human hand. The handle means and the upright portion are molded from a plastic material as an integral one piece unit, with the handle means being configured to freely fit within the smaller end of the conical hollow interior when another identical delineator is stacked on it.

DETAILED DESCRIPTION OF PREFERRED EMBODIMENTS

Figure 4:
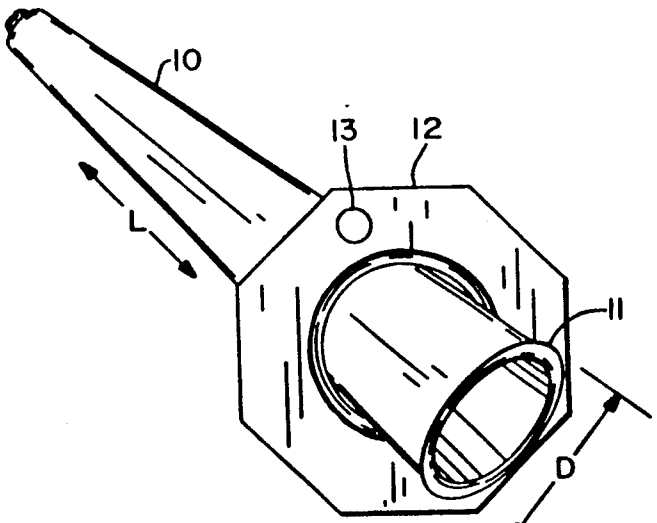
FIG. 4 is a perspective view of the delineator of FIG. 1 showing the base detached from the conical portion.
Figure 1:
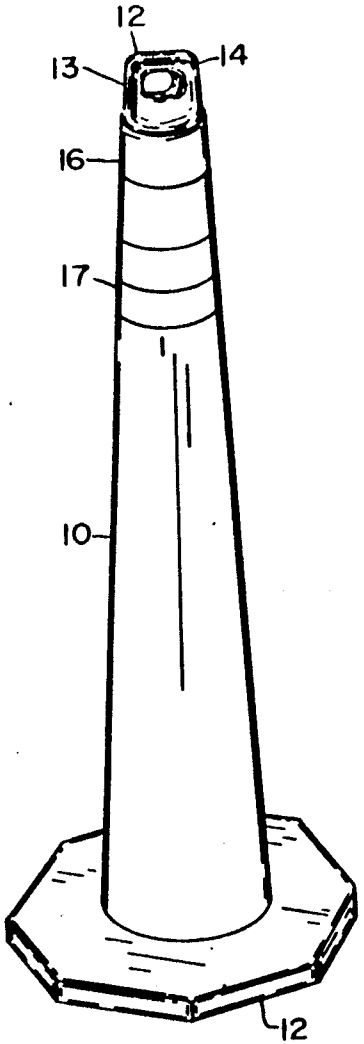
FIG. 1 is a perspective view of one embodiment of a delineator in accordance with the present invention.

FIG. 1 illustrates the delineator of the present invention with an upright portion 10 which is conically shaped and blow molded of a low density polyethylene plastic material to provide flexibility and elasticity to impacts. Its wider lower end, as best illustrated in FIG. 4, includes a flange 11 which retains a detachable octagon shaped base 12. In normal practice base 12 is hollow and includes a fill hole 13 which is used for filling the base with sand to give it its weight. The fill hole is plugged with some suitable stopper. The base is separately constructed of less expensive high density plastic.

At the upper smaller conical end of upright portion 10 is a handle 12, which is graspable by the fingers of a human hand. In the specific embodiment illustrated in FIG. 1, handle 12 is generally U-shaped with its legs 13 and 14 having exterior faces which are coincident or in line with the conical surface determined by the remainder of conically shaped upright portion 10.

Reflective bands 16 and 17 are illustrated but may be of any desired color and shape, depending on use. In addition, rather than a reflective band, a color may be added to the polyethylene plastic material, such as highway orange.

Upright portion 10 with its handle 12 is blow molded as an integral one piece unit. In the blow molding process a forming tube termed a parison is utilized and air or other gas causes the tube to expand against a mold, forming the object. This is believed to be a superior technique when an integrally molded handle is desired on a conically shaped plastic tube. The base 12 is constructed separately.

Figure 2:
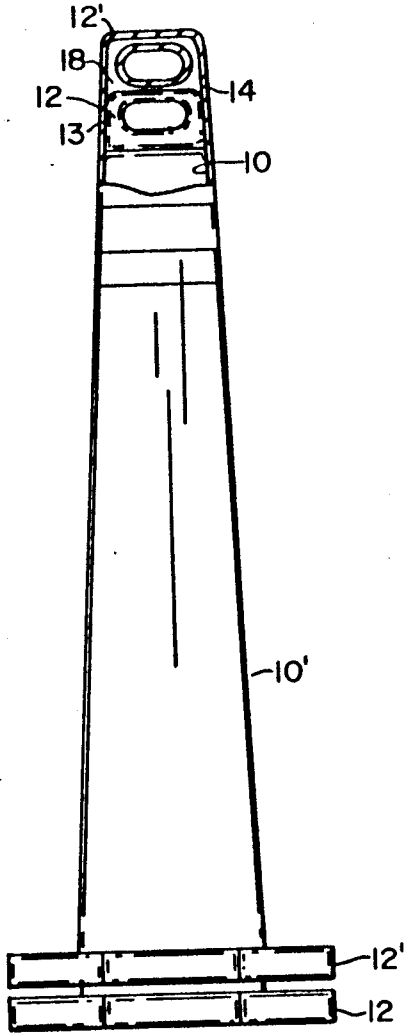
FIG. 2 is a side view showing two stacked delineators embodying the present invention.

In order to provide a stackable delineator, handle 12 is configured so as to freely fit within the smaller end of the conical hollow interior of upright portion 10. This is illustrated in FIG. 2 where two identical delineators—second being illustrated with a prime—are stacked together. Thus, the interior of the second delineator 10' is shown as 18 and indicates how there is sufficient clearance for stackability since the U-shaped handle has the exterior faces of legs 13 and 14 coincident with the conical surface of the conical portion 10. The cross section of FIG. 2 and the handle 12' also indicate the integral one piece nature of upright portion 10' and its handle 12'.

Figure 3:
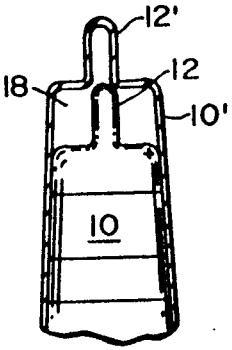
FIG. 3 is a cutaway side view of the top portion of FIG. 2 from a different viewpoint.

FIG. 3 illustrates another view of the stacked delineators of FIG. 2 taken 90° away, showing the space 18 at the smaller conical end of the upright portion 10' and the handles 12' and 12.

Figure 5:
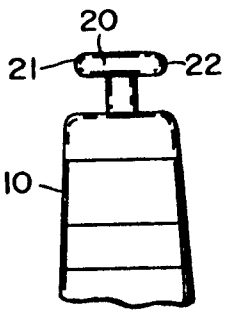
FIG. 5 is a side view of the top portion of another embodiment of the delineator of the present invention.

Rather than a U-shaped handle, as illustrated in FIG. 5, a one piece T-shaped handle 20 may also be utilized. Here the ends of the T of the handle 21 and 22 must lie within the conical projection of the sides of the upright portion 10, as shown by the dashed lines.

From a dimensional point of view (see FIG. 4), the preferred dimensions of the delineator are believed to be a diameter D at the large flanged end 11 of 8½" and a length L of 42". With this dimensioning, the slope of the sides is 16½°. Thus, the ratio of length to diameter is approximately 5:1. With the sand-filed weighted base 12, as illustrated in FIG. 1, the delineator can be tipped very close to the ground and still recover its normal vertical orientation.

In operation, one delineator is either stacked or unstacked onto or from another by merely grasping the handle 12', as shown in FIG. 2.

Thus, a stackable road delineator has been provided.

I claim:

1. A stackable road delineator adapted to be placed on a road surface by a human hand, comprising a base having a base surface adapted to rest on said road surface and having a centrally disposed circular opening therein which is disposed in a direction which is perpendicular to the base surface, a conical member detachably disposed in said circular opening in said base and extending upwardly from the base, said conical member having upper and lower extremities, the lower extremity being disposed within said circular opening and having an outwardly extending flange on the lower extremity and having a diameter greater than the diameter of the circular opening in the base and engaging said base surface so that the conical member is supported in an upright position by said base when said road delineator is disposed on said road surface, said conical member having a conical exterior surface free of protrusions to facilitate assembly and disassembly of the conical member from the base, said upper extremity of the conical member having an external handle mean formed thereon and extending therefrom, said handle means being sized so that it is within the confines of a projection of said exterior surface of the conical member and includes a pair of exterior faces substantially coincident with said projection, said handle means having at least one undercut space therein adapted to receive the fingers of the human hand to facilitate carrying of the road delineator by the human hand and for stacking and unstacking, said conical member having a conical shaped interior recess therein to permit stacking of the road delineators one on top of the other, said conical member and handle means being blow molded as an integral one piece unit of a material different from said base

2. A road delineator as in claim 1 together with at least one reflective band carried by the upper portion of the conical member and extending circumferentially of the conical member.

3. A road delineator as in claim 1 wherein said conical member is formed of a plastic material which is resistant to damage by impact.

4. A road delineator as in claim 1 wherein said base is formed of a resilient relatively heavy material to stabilize the road delineator.

5. A stackable road delineator adapted to be placed on a road surface by a human hand, comprising a base having a base surface adapted to rest on said road surface and having a centrally disposed circular opening therein which is disposed in a direction which is perpendicular to the base surface, a conical member detachably disposed in the circular opening in said base and extending upwardly from the base, said conical member having upper and lower extremities, the lower extremity being disposed within said circular opening and having an outwardly extending flange on the lower extremity and having a diameter greater than the diameter of the circular opening in the base and engaging said base surface so that the conical member is supported in an upright position by said base when said road delineator is disposed on said road surface, said conical member having a conical exterior surface free of protrusions to facilitate assembly and disassembly of the conical member from the base, said upper extremity of the conical member having an external handle means formed thereon and extending therefrom, said handle means being sized so that it is within the confines of a projection of said exterior surface of the conical member and includes a pair of exterior faces lying within said projection, said handle means having at least one undercut space therein adapted to receive the fingers of the human hand to facilitate carrying of the road delineator by the human hand and of stacking and unstacking, said conical member having a conical shaped interior recess therein to permit stacking of the road delineators one on top of the other, said conical member and handle means being blow molded as an integral one piece unit of a material different from said base.

6. A road delineator as in claim 5 together with at least one reflective band carried by the upper portion of the conical member and extending circumferentially of the conical member.

7. A road delineator as in claim 5 wherein said conical member is formed of a plastic material which is resistant to damage by impact.

8. A road delineator as in claim 5 wherein said base is formed of a resilient relatively heavy material to stabilize the road delineator.

* * * * *